US006346054B1

(12) United States Patent
Shimosaka et al.

(10) Patent No.: US 6,346,054 B1
(45) Date of Patent: Feb. 12, 2002

(54) DIMPLED GOLF BALL

(75) Inventors: Hirotaka Shimosaka; Keisuke Ihara; Atsuki Kasashima, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/383,205

(22) Filed: Aug. 26, 1999

(30) Foreign Application Priority Data

Aug. 26, 1998 (JP) ..... 10-240856

(51) Int. Cl.[7] ..... A63B 37/14
(52) U.S. Cl. ..... 473/383; 473/378
(58) Field of Search ..... 473/376, 374, 473/384, 379, 378, 380, 381, 382, 383

(56) References Cited

U.S. PATENT DOCUMENTS 2,939,710 A * 6/1960 Dosmann et al. ..... 473/376
4,844,472 A * 7/1989 Ihara ..... 473/384
4,991,852 A * 2/1991 Pattison ..... 473/384
5,009,428 A * 4/1991 Yamagishi et al. ..... 473/379
5,249,804 A * 10/1993 Sanchez ..... 473/378
5,527,043 A 6/1996 Shimosaka
5,816,937 A * 10/1998 Shimosaka et al. ..... 473/376

* cited by examiner

*Primary Examiner*—Mark S. Graham
*Assistant Examiner*—Raeann Gorden
(74) *Attorney, Agent, or Firm*—Sughrue Mion, PLLC

(57) ABSTRACT

When the spherical surface of a golf ball is divided into a plurality of substantially congruent spherical triangles, dimples are substantially equally distributed in the spherical triangles. The spherical triangles are minimum triangular units which are substantially congruent with each other. The dimples distributed in each minimum triangular unit include crossing dimples that each lie across a side of the minimum triangular unit. The total of the crossing lengths of the crossing dimples is 70–80% of the total side length of the minimum triangular unit. The golf ball is improved in the symmetry of elevation angle and carry, and has good aerodynamic performance and an increased total flight distance.

19 Claims, 6 Drawing Sheets

(Comparative Example 1)

(Comparative Example 2)

(Comparative Example 3)

(Comparative Example 4)

(Comparative Example 5)

DIMPLED GOLF BALL

This invention relates to a golf ball having excellent flight performance.

BACKGROUND OF THE INVENTION

In general, golf balls are provided with a multiplicity of dimples of circular plane shape on their surface for the purpose of improving their aerodynamic properties. It is well known that the dimpled golf balls are far better in flight behavior than smooth golf balls free of dimples.

The flight distance of golf balls depends on the initial velocity, drag and lift acting on the ball in flight, spin rate, and other factors such as weather conditions. The initial velocity is largely governed by the constituent materials and structure of the ball. The dimples are correlated to the drag and lift in flight and the spin rate and thus affect the flight distance. A number of proposals have been made on the arrangement of dimples.

The dimple arrangement is generally determined by assuming the golf ball to be a regular polyhedron, typically a regular icosahedron or octahedron to divide the spherical surface into spherical polygons, using each spherical polygon as a unit, suitably arranging dimples of circular plane shape and of one type or plural types which are different in size, and expanding this arrangement over the entire spherical surface.

The dimple arrangement or distribution looks uniform when the overall spherical surface is viewed. However, when polygonal units, specifically triangular units of a regular icosahedron or octahedron are considered, the number of dimples on the delimiting line between adjacent triangular units is often smaller than in the remaining portion, that is, the lands (that is, the regions where no dimples are formed) are formed along the delimiting line over a relatively long distance. As a consequence, there is a tendency that the uniform arrangement of dimples is disrupted at the delimiting line. A golf ball with such a dimple arrangement often exhibits a difference in flight distance between pole hitting and seam hitting, lacking the symmetry of elevation angle and carry when hit. Provided that a ball is molded in a mold of two separable halves so that the ball has an equator plane corresponding to the parting plane of the mold, the term "pole hitting" means that the ball is hit to give a back spin about an axis passing the center of the equator plane parallel to the equator plane. The term "seam hitting" means that the ball is hit to give a back spin about an axis passing the opposed poles of the ball perpendicular to the equator plane.

As mentioned above, golf balls tend to exhibit flight differences depending on the hitting mode because of variances or biases in their manufacturing process and dimple arrangement. To compensate for such biases, various proposals have been made. Japanese Patent No. 2,569,515 discloses a golf ball which is formed to achieve the symmetry of elevation angle between the pole hitting and the seam hitting (to minimize the difference in elevation angle between the pole hitting and the seam hitting). The symmetry of carry is not always satisfactory in the high head speed region.

SUMMARY OF THE INVENTION

An object of the invention is to provide a golf ball which is improved in the symmetry of elevation angle and carry, and has good aerodynamic performance and an increased total flight distance.

According to the invention, there is provided a golf ball having a spherical surface, wherein when the spherical surface is divided into a plurality of substantially congruent spherical triangles, dimples are substantially equally distributed in the spherical triangles. The spherical triangles are minimum triangular units which are substantially congruent with each other. The dimples distributed in each minimum triangular unit include crossing dimples that each lie across at least one side of the minimum triangular unit. The total of the crossing lengths of the dimples which lie across the respective sides of the minimum triangular unit is 70 to 80%, and preferably 75 to 80%, of the total length of all the sides of the minimum triangular unit.

In one preferred embodiment, the minimum triangular unit is obtained by dividing the spherical surface into twenty spherical triangles of a regular icosahedron, and drawing perpendicular lines from the apexes of each said spherical triangle to divide the triangle into six triangular units. In another preferred embodiment, the minimum triangular unit is obtained by dividing the spherical surface at its equator into north and south hemispheres, and dividing each hemisphere about its pole along longitudes into six spherical triangular units having a vertex angle of 60°, thus defining twelve spherical triangular units in total. Also preferably, the dimples account for 70 to 80% of the entire surface area of the ball, that is, the dimple area coverage is 70 to 80%. As to the golf ball structure, a golf ball comprising a solid core of a single layer or plural layers and a cover of at least one layer enclosing the core is preferred.

The inventor has found that a golf ball having a dimple arrangement satisfying the above-mentioned specific requirement is improved in the symmetry of elevation angle and carry and will travel an increased total distance.

DESCRIPTION OF THE PREFERRED EMBODIMENTS

The invention is directed to a golf ball having a spherical surface. When the spherical surface is divided into a plurality of substantially congruent spherical triangles, dimples are substantially equally distributed in the spherical triangles. The spherical triangles are minimum triangular units which are substantially congruent with each other. The dimples distributed in each minimum triangular unit include crossing dimples that each lie across a side of the minimum triangular unit.

Herein, the terms "triangle," "triangular unit," and "minimum triangular unit" each designate a spherical triangle defined by connecting three points on the spherical surface by great circles. The congruent triangular regions mean that two triangles are congruent with each other and that the dimple arrangements in these two triangular regions are identical or when the corresponding sides of the two triangular regions coincide, the dimple arrangements in the triangular regions are axi-symmetric with respect to the axis given by the sides. When the dimple arrangement on the spherical surface is divided into triangular regions which are substantially congruent, these triangular regions are designated triangular units, and the smallest ones of these triangular units are designated minimum triangular units.

Figure 1:
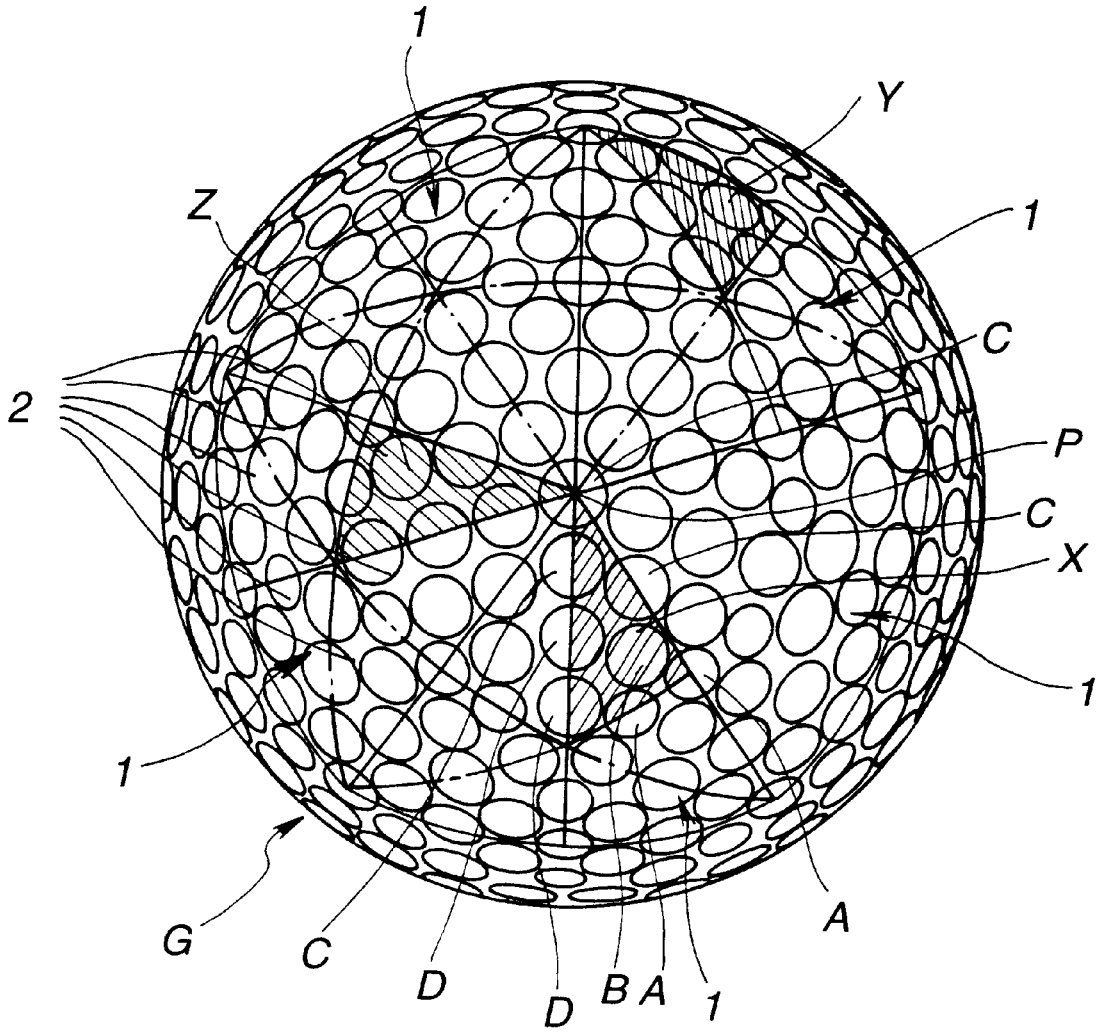
FIG. 1 illustrates a dimple arrangement pattern on a golf ball according to a first embodiment of the invention, as viewed from above the pole.

Exemplary minimum triangular units are obtained by dividing the spherical surface into spherical triangles which are congruent with each other. This is in accordance with a division method used in well-known dimple arrangements such as regular octahedral and regular icosahedral arrangements, and if the spherical triangles can be further divided into minimum triangular units of substantial congruence, further dividing each of the spherical triangles into minimum triangular units. More illustratively, the minimum triangular units are obtained, as shown in FIGS. 1 and 2, by dividing the spherical surface into spherical triangular units 1 of a regular icosahedron and drawing perpendicular lines from the apexes of each triangular unit 1 to the corresponding bottom sides to define minimum triangular units 2. Alternatively, the minimum triangular unit is obtained, as shown in FIG. 3, by dividing the spherical surface at its equator E into north and south hemispheres, and dividing each of the north and south hemispheres about its north or south pole P along longitudes into six spherical triangular units 2 having a vertex angle $\beta$ of 60°, thus defining twelve spherical triangular units 2 in total.

According to the invention, a plurality of dimples are equally (with respect to the number, type and arrangement pattern of dimples) distributed in the minimum triangular units. The dimples distributed in each minimum triangular unit include crossing dimples that each lie across a side of the minimum triangular unit. Differently stated, two adjoining minimum triangular units share such a crossing dimple or dimples. The total of the crossing lengths of the dimples which lie across the respective sides of the minimum triangular unit is 70 to 80%, and especially 75 to 80% of the total length of all the sides of the minimum triangular unit. If the total traversed length divided by the total side length is less than 70%, a greater carry is developed by the pole hitting. If more than 80%, a greater carry is developed by the seam hitting.

The golf ball having dimples according to the invention preferably has a dimple area coverage of 70 to 80%. The dimple area coverage is the sum of areas of dimples (circular in plane shape) divided by the entire surface area of an imaginary sphere given on the assumption that no dimples are on the golf ball surface, expressed as a percentage. The total number of dimples is preferably 320 to 500, more preferably 428 to 492. Dimples of one type which are equal in diameter and depth are acceptable while at least two types, especially two to six types of dimples which are different in diameter and/or depth may be formed and are preferred in many cases. The diameter of dimples may be selected in the range of 1.8 to 4.5 mm, especially 2.2 to 3.8 mm and the depth may be selected in the range of 0.07 to 0.22 mm, especially 0.1 to 0.19 mm. It is noted that the depth of a dimple is defined as the shortest distance from a plane connecting dimple edges together to the deepest bottom of the dimple.

Referring to the drawings, specific examples of the golf ball according to the invention are described. FIG. 1 is a plan view of a golf ball G according to a first embodiment of the invention, as viewed from above its pole P. When the spherical surface of the golf ball G is divided into twenty spherical triangles of a regular icosahedron, each spherical triangle becomes a triangular unit 1, and dimples are regularly and substantially equally distributed in the spherical triangles.

More particularly, FIG. 1 is a view of the golf ball G as viewed from above the pole P. The ball is herein assumed to be a regular icosahedron having twenty triangles, of which five spherical triangles 1 are depicted about the pole P. In the triangular units including those triangles not seen in the figure, there are distributed dimples of the same types and arrangement as those of the depicted dimples.

Each triangular unit 1 is divided into six minimum triangular units 2 by drawing perpendicular lines from the apexes of the triangle to the corresponding bottom sides.

Of the thus defined minimum triangular units 2, X and Y designate the triangular units whose dimple arrangements are congruent or identical, a pair of Y and Z or a pair of X and Z designate that when the two triangles are adjoined, their shapes and dimple arrangements are symmetric with respect to the conjoint axis (that is, congruent as used herein).

In the first embodiment, dimples A having a diameter of 3 mm, dimples B having a diameter of 3.4 mm, dimples C having a diameter of 3.6 mm, and dimples D having a diameter of 3.8 mm are distributed. These dimples have an increasing depth in the order of A, B, C and D.

Some dimples are disposed such that their centers are positioned on the delimiting lines or three sides (longest, second longest and shortest sides) of the minimum triangular unit 2. The total of the crossing lengths of the dimples traversing the sides is 73% of the total length of all the delimiting lines (that is, the sum of the three sides of the minimum triangular unit 2).

In the first embodiment shown in FIG. 1, the number of dimples A, B, C and D is 90, 120, 132, and 120, respectively, totaling to 462 dimples. All the dimples account for 77% of the surface of the golf ball.

Figure 2A:
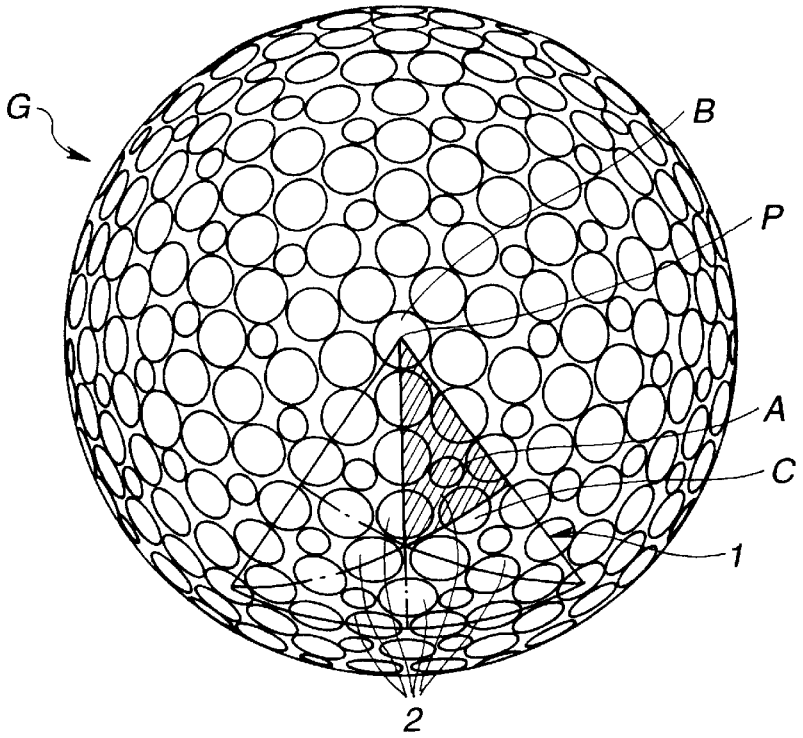
FIGS. 2*a* and 2*b* illustrate a dimple arrangement pattern on a golf ball according to a second embodiment of the invention, as viewed from above the pole and the seam, respectively.
Figure 2B:
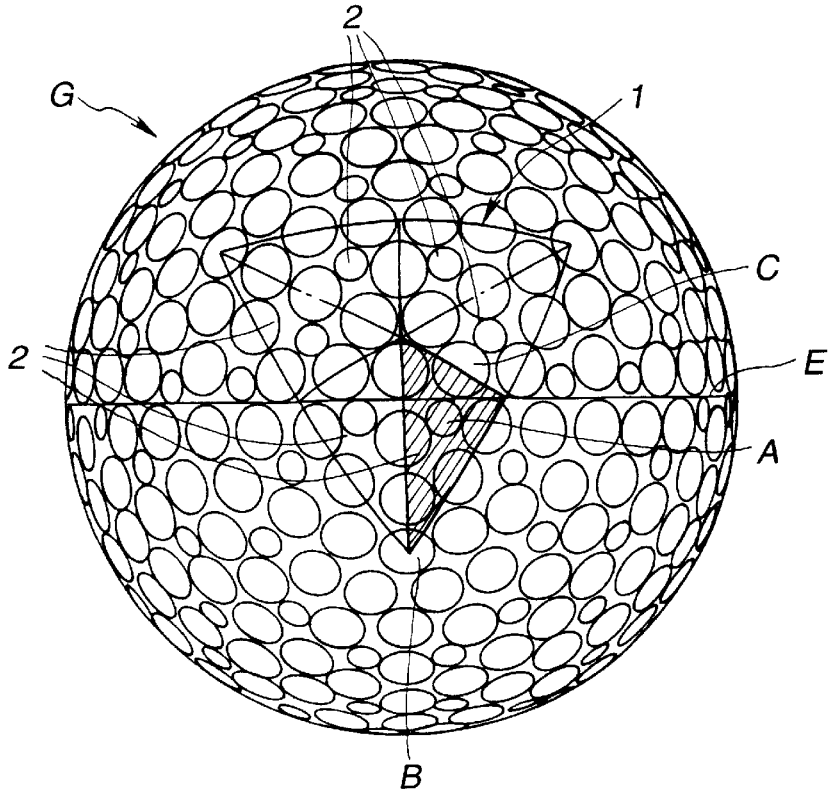
Figure 3:
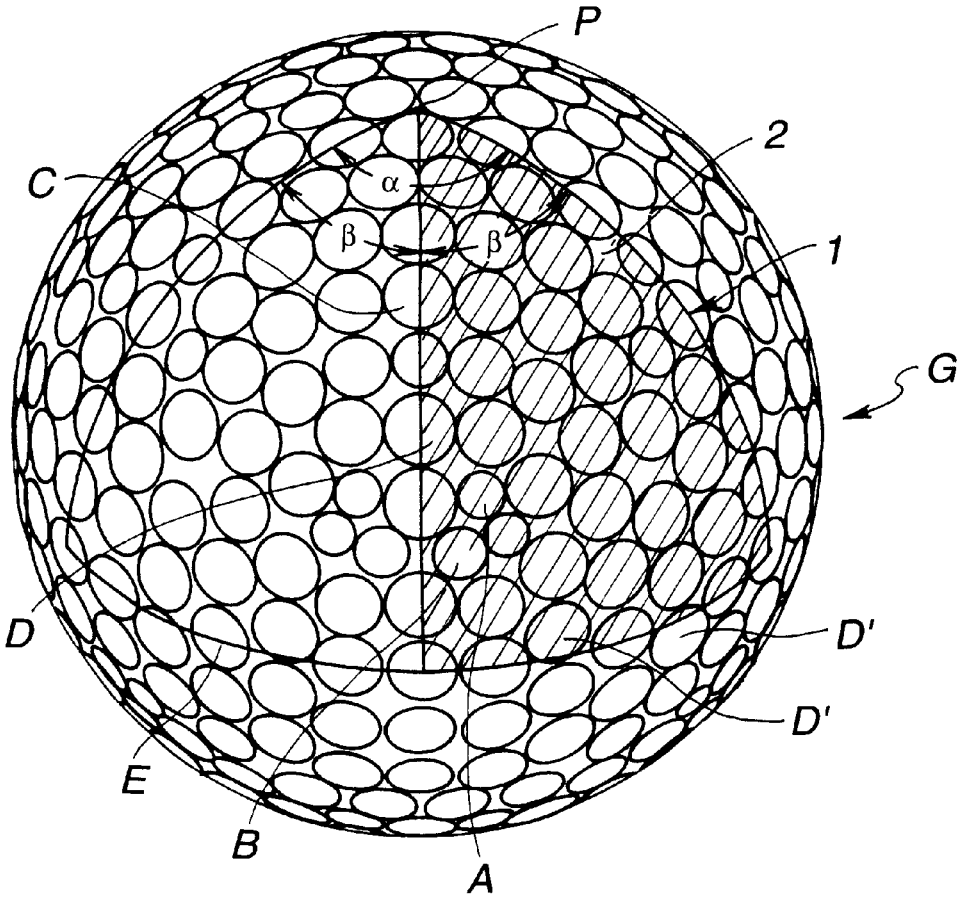
FIG. 3 illustrates a dimple arrangement pattern on a golf ball according to a third embodiment of the invention.

FIG. 2 illustrates a golf ball according to a second embodiment of the invention. FIG. 2*a* is a plan view of the golf ball as viewed from above its pole P, and FIG. 2*b* is a side view of the golf ball as viewed from above its equator E or parting line.

Like the first embodiment, the second embodiment assumes the golf ball to be a regular icosahedron. In each triangular unit 1, dimples A having a diameter of 2.2 mm, dimples B having a diameter of 3.6 mm, and dimples C having a diameter of 3.8 mm are distributed as shown in the figure. The triangular unit 1 is further divided into congruent triangles, that is, minimum triangular units 2. The total of the crossing lengths of the dimples traversing the sides is 77% of the total length of all the delimiting lines of the minimum triangular unit 2. The number of dimples A, B, and C is 120, 192, and 180, respectively, totaling to 492 dimples. All the dimples account for 78% of the entire surface of the golf ball.

FIG. 3 is a perspective view of a golf ball according to a third embodiment of the invention. In this embodiment, the spherical surface is divided at the equator E into north and south hemispheres. Each of the north and south hemispheres is divided about its north or south pole P along longitudes into three spherical triangular units 1 having a vertex angle $\alpha$ of 120° (six spherical triangular units 1 in total). Each spherical triangular unit is further divided into two equal triangular units 2 having a vertex angle $\beta$ of 60°, thus defining twelve minimum triangular units 2 in total.

In the third embodiment, dimples A having a diameter of 2.5 mm, dimples B having a diameter of 2.9 mm, dimples C having a diameter of 3.6 mm, and dimples D having a diameter of 3.8 mm are distributed. The number of dimples A, B, C, and D is 24, 36, 180, and 198, respectively, totaling to 428 dimples. All the dimples account for 78% of the entire surface of the golf ball.

In the first and second embodiments, the dimple lying across a side of the minimum triangular unit 2 is generally disposed so that the side divides the dimple into substantially equal two halves. In addition to the centrally crossing dimples, the third embodiment includes two dimples designated D' which slightly lie across the side of the minimum triangular unit 2 that is coincident with the equator E.

In FIG. 3, the triangular unit 1 is further divided into two congruent triangles serving as minimum triangular units 2. The total of the crossing lengths of the crossing dimples is 78% of the total length of all the delimiting lines of the minimum triangular unit 2.

In an alternative embodiment, though not shown, the golf ball is assumed to be a regular octahedron. That is, the spherical surface of the golf ball is divided into eight regular triangular units. Each regular triangular unit is divided into six minimum triangular units by drawing perpendicular lines from the apexes to the corresponding bottom sides, defining 48 minimum triangular units in total. As in the above-described first to third embodiments, dimples of plural types may be selected and distributed in each minimum triangular unit in accordance with the feature of the present invention.

Figure 4:
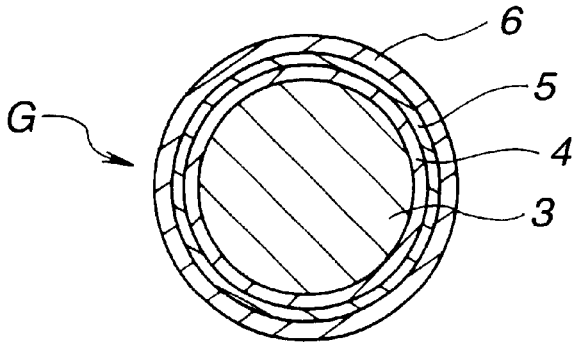
FIG. 4 is a cross-sectional view of one exemplary golf ball according to the invention.

In the practice of the invention, the structure of the golf ball may be either a solid golf ball or a wound golf ball. Preferred is a solid golf ball comprising a core and a cover in which the core is a single layer core or a multilayer structure core, and the cover is a single layer cover or a multilayer structure consisting of plural layers having different physical properties, especially a multilayer structure consisting of at least three layers having different physical properties. For example, FIG. 4 shows a four-layer structure golf ball comprising a single layer core 3 and a cover consisting of three layers having different physical properties, that is, an inner layer 4, an intermediate layer 5, and an outer layer 6.

EXAMPLE

Examples of the invention are given below by way of illustration and not by way of limitation.

Examples 1–3 and Comparative Examples 1–5

Two-piece solid golf balls of the large size were manufactured which had dimples as shown in Table 1 distributed in minimum triangular units as shown in Tables 2 to 10. Notably, golf balls of Comparative Examples 1 to 5 were manufactured in accordance with the patent publications noted below Tables 5 to 10.

Each of the golf balls shown in Tables 2 to 5 and Tables 7 to 10 was hit in the seam hitting mode and the pole hitting mode whereupon the spin rate, elevation angle, carry and total distance was examined by the following method. The results are shown in Table 11.

Test Conditions

Using a swing robot equipped with a driver (Tour Stage X100 by Bridgestone Sport Co., Ltd.), the same golf ball was hit 6 times in the pole or seam hitting mode at a head speed of 51 m/sec. Average values of carry, run and total were determined. The symmetry of elevation angle or carry was evaluated in terms of a difference between an average on the pole hitting and an average on the seam hitting.

It is noted that the solid cores of the two-piece golf balls were formed to a diameter of 39.07 mm by molding and vulcanizing the following rubber composition at 155° C. for 18 minutes. The following cover composition was injection molded over the cores to form covers, yielding two-piece solid golf balls having a diameter of 42.67 mm.

| Rubber composition | Parts by weight |
|---|---|
| Cis-1,4-polybutadiene | 100 |
| Zinc acrylate | 24 |
| Zinc oxide | 19 |
| Antioxidant | 1 |
| Dicumyl peroxide | 1 |

Cover Composition

Ionomer resin

Shore D hardness 54, gage 1.8 mm

The golf balls of Examples 1 to 3 had the dimples (whose number and type are shown in Table 1) distributed in the arrangements shown in FIGS. 1 to 3. The golf balls of Comparative Examples 1 to 5 had the dimples (whose number and type are shown in Table 1) distributed in the arrangements shown in FIGS. 5, 7, 8, 9 and 10.

TABLE 1

| | Dimple No. 1 | | | Dimple No. 2 | | | Dimple No. 3 | | | Dimple No. 4 | | |
|---|---|---|---|---|---|---|---|---|---|---|---|---|
| | Number | Diameter (mm) | Depth (mm) | Number | Diameter (mm) | Depth (mm) | Number | Diameter (mm) | Depth (mm) | Number | Diameter (mm) | Depth (mm) |
| E1 | 120 | 3.8 | 0.16 | 132 | 3.6 | 0.15 | 120 | 3.4 | 0.14 | 90 | 3.0 | 0.12 |
| E2 | 180 | 3.8 | 0.17 | 192 | 3.6 | 0.16 | 120 | 2.2 | 0.10 | | | |
| E3 | 198 | 3.8 | 0.17 | 180 | 3.6 | 0.16 | 36 | 2.9 | 0.10 | 24 | 2.5 | 0.10 |
| CE1 | 60 | 3.81 | 0.17 | 180 | 3.56 | 0.15 | 180 | 3.43 | 0.14 | | | |
| CE2 | 392 | 3.56 | 0.17 | | | | | | | | | |
| CE3 | 60 | 3.8 | 0.14 | 60 | 3.6 | 0.14 | 240 | 3.4 | 0.13 | 132 | 2.9 | 0.13 |

TABLE 1-continued

| | Dimple No. 1 | | | Dimple No. 2 | | | Dimple No. 3 | | | Dimple No. 4 | | |
|---|---|---|---|---|---|---|---|---|---|---|---|---|
| | Number | Diameter (mm) | Depth (mm) | Number | Diameter (mm) | Depth (mm) | Number | Diameter (mm) | Depth (mm) | Number | Diameter (mm) | Depth (mm) |
| CE4 | 368 | 3.91 | 0.15 | 72 | 3.78 | 0.14 | | | | | | |
| CE5 | 120 | 3.81 | 0.18 | 242 | 3.56 | 0.17 | | | | | | |

TABLE 2

Example 1

| Minimum triangular unit* | Length of side (mm) | Dimple crossing length (mm) | Proportion (%) |
|---|---|---|---|
| Longest side | 13.9 | 13.0 | 93 |
| Second longest side | 11.8 | 6.9 | 58 |
| Shortest side | 7.7 | 4.5 | 51 |
| Total | 33.5 | 24.4 | 73 |

*regular icosahedral arrangement. The minimum triangular units are congruent triangles sized 1/120 of the spherical surface.

TABLE 3

Example 2

| Minimum triangular unit* | Length of side (mm) | Dimple crossing length (mm) | Proportion (%) |
|---|---|---|---|
| Longest side | 13.9 | 13.0 | 93 |
| Second longest side | 11.8 | 9.0 | 76 |
| Shortest side | 7.7 | 3.8 | 49 |
| Total | 33.5 | 25.8 | 77 |

*regular icosahedral arrangement with minor modification only at the equator region. The minimum triangular units are substantially congruent triangles sized 1/120 of the spherical surface.

* regular icosahedral arrangement where the minimum triangular units are congruent triangles sized 1/120 of the spherical surface.

TABLE 4

Example 3

| Minimum triangular unit* | Length of side (mm) | Dimple crossing length (mm) | Proportion (%) |
|---|---|---|---|
| Longest side | 33.5 | 27.4 | 82 |
| Second longest side | 33.5 | 23.6 | 70 |
| Shortest side | 22.3 | 19.0 | 85 |
| Total | 89.3 | 70.0 | 78 |

*The dimple arrangement is determined by dividing each hemisphere into six congruent triangles. The minimum triangular units are substantially congruent triangles sized 1/12 of the spherical surface.

* The dimple arrangement is determined by dividing each hemisphere into six congruent triangles. the minimum triangular units are substantially congruent triangles sized 1/12 of the spherical surface.

TABLE 5

Comparative Example 1

| Minimum triangular unit* | Length of side (mm) | Dimple crossing length (mm) | Proportion (%) |
|---|---|---|---|
| Longest side | 13.9 | 8.9 | 64 |
| Second longest side | 11.8 | 8.7 | 74 |
| Shortest side | 7.7 | 3.4 | 44 |
| Total | 33.5 | 21.0 | 63 |

Figure 5:
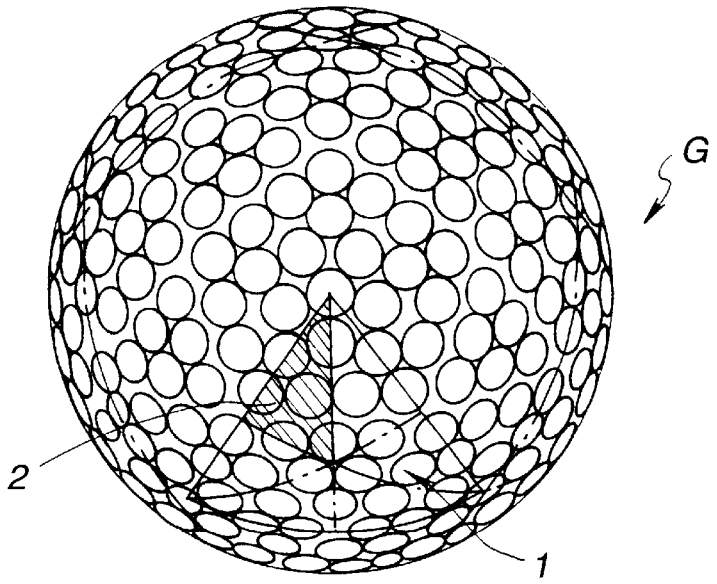
FIG.5 PRIOR ART
FIG. 5 illustrates a dimple arrangement pattern on a golf ball of Comparative Example 1.

The golf ball is reproduced from JP-A 60-234674 and shown in FIG. 5.

* regular icosahedral arrangement where the minimum triangular units are congruent triangles sized 1/120 of the spherical surface.

TABLE 6

Reference Example

| Minimum triangular unit* | Length of side (mm) | Dimple crossing length (mm) | Proportion (%) |
|---|---|---|---|
| Longest side | 13.9 | 8.7 | 63 |
| Second longest side | 11.8 | 6.8 | 58 |
| Shortest side | 7.7 | 4.0 | 52 |
| Total | 33.5 | 19.5 | 58 |

Figure 6:
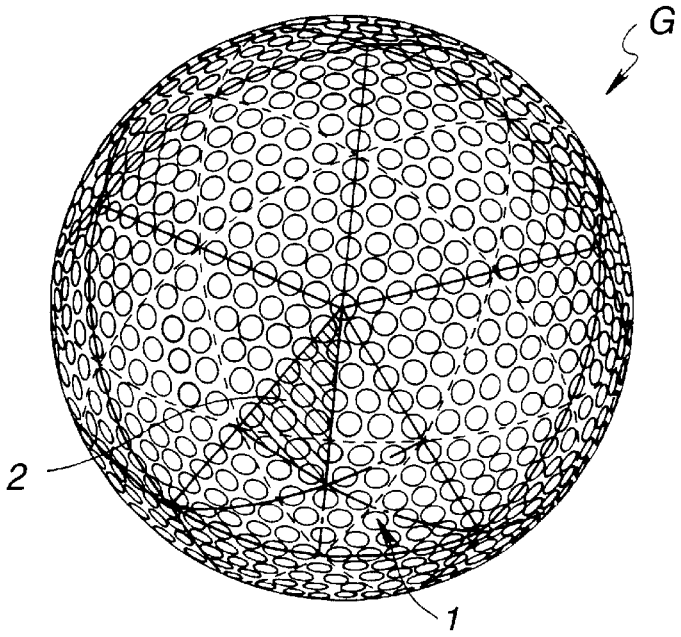
FIG. 6 illustrates a dimple arrangement pattern on a golf ball of Reference Example.
Figure 7:
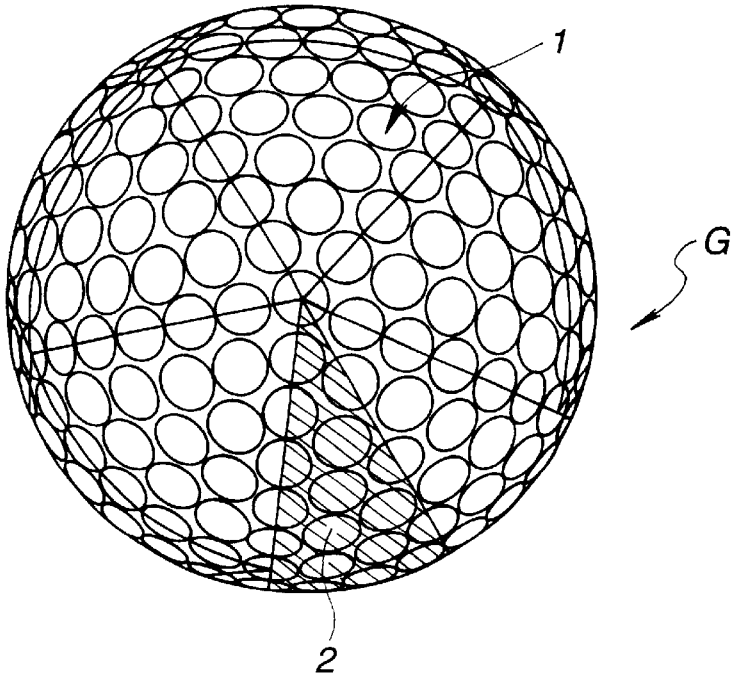
FIG.7 PRIOR ART
FIG. 7 illustrates a dimple arrangement pattern on a golf ball of Comparative Example 2.

The golf ball is reproduced from JP-A 60-234674 and shown in FIG. 6.

* regular icosahedral arrangement where the minimum triangular units are congruent triangles sized 1/120of the sperical surface.

TABLE 7

Comparative Example 2

| Minimum triangular unit* | Length of side (mm) | Dimple crossing length (mm) | Proportion (%) |
|---|---|---|---|
| Longest side | 33.5 | 27.6 | 82 |
| Second longest side | 33.5 | 16.5 | 49 |
| Shortest side | 13.4 | 0 | 0 |
| Total | 80.4 | 44.1 | 55 |

* regular icosahedral arrangement. The minimum triangular units are congruent triangles sized 1/10 of the hemisphere.

Although the design is based on the regular icosahedral arrangement, the dimples in the first row are modified because these dimples lie across the equator. Because of the first row of dimples to which modification is made, the regular icosahedral arrangement is somewhat disordered.

TABLE 8

Comparative Example 3

| Minimum triangular unit* | Length of side (mm) | Dimple crossing length (mm) | Proportion (%) |
|---|---|---|---|
| Longest side | 13.9 | 7.4 | 53 |
| Second longest side | 11.8 | 11.1 | 94 |
| Shortest side | 7.7 | 3.8 | 49 |
| Total | 33.5 | 22.4 | 67 |

* regular icosahedral arrangement. The minimum triangular units are congruent triangles sized 1/120 of the spherical surface.

Figure 8:
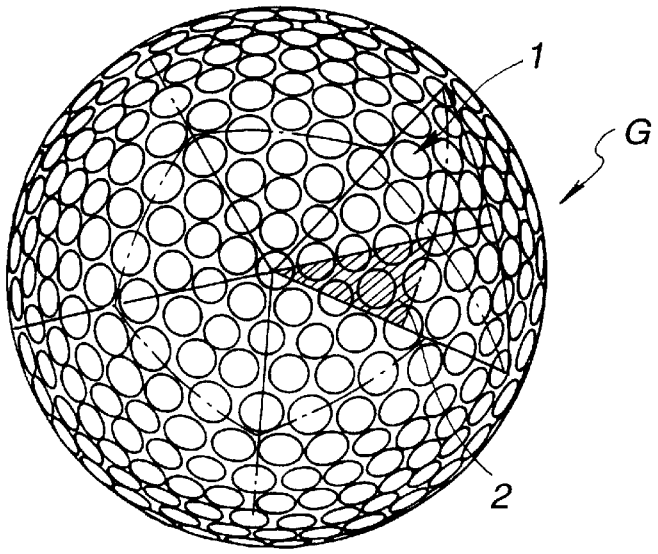
FIG.8 PRIOR ART
FIG. 8 illustrates a dimple arrangement pattern on a golf ball of Comparative Example 3.

The golf ball is reproduced from JP-A 62-192181 and shown in FIG. 8.

Although the design is based on the regular icosahedral arrangement, the dimples in the first row are modified because these dimples lie across the equator. Namely, modification is made on the dimples in the equator region.

TABLE 9

| Comparative Example 4 | | | |
|---|---|---|---|
| Minimum triangular unit* | Length of side (mm) | Dimple crossing length (mm) | Proportion (%) |
| Longest side | 20.3 | 9.6 | 47 |
| Second longest side | 16.7 | 0 | 0 |
| Shortest side | 13.1 | 5.8 | 45 |
| Total | 50.2 | 15.5 | 31 |

* regular octahedral arrangement. The minimum triangular units are congruent triangles sized 1/48 of the spherical surface.

Figure 9:
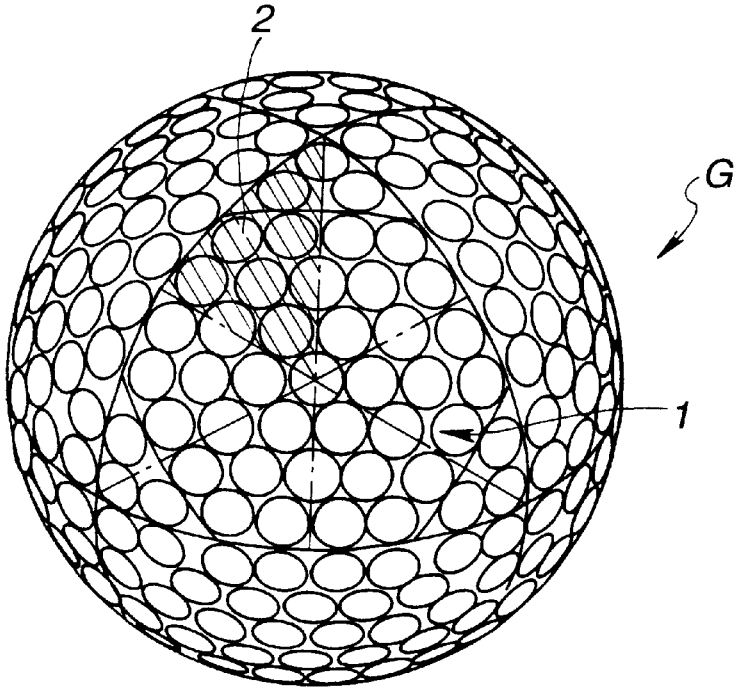
FIG.9 PRIOR ART
FIG. 9 illustrates a dimple arrangement pattern on a golf ball of Comparative Example 4.

The golf ball is reproduced from JP-A 64-95072 and shown in FIG. 9.

TABLE 10

| Comparative Example 5 | | | |
|---|---|---|---|
| Minimum triangular unit* | Length of side (mm) | Dimple crossing length (mm) | Proportion (%) |
| Longest side | 13.9 | 10.9 | 79 |
| Second longest side | 11.8 | 10.6 | 90 |
| Shortest side | 7.7 | 7.3 | 95 |
| Total | 33.5 | 28.9 | 86 |

* regular icosahedral arrangement. The minimum triangular units are congruent triangles sized 1/120 of the spherical surface.

Figure 10:
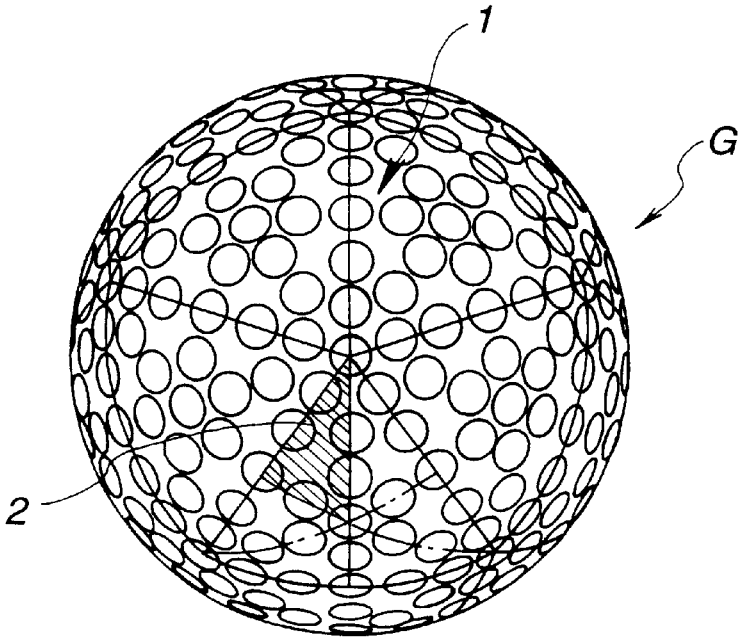
FIG.10 PRIOR ART
FIG. 10 illustrates a dimple arrangement pattern on a golf ball of Comparative Example 5.

The golf ball is reproduced from JP-A 7-67985 and shown in FIG. 10.

Although the design is based on the regular icosahedral arrangement, the dimples in the first row are modified because these dimples lie across the equator. Namely, modification is made on the dimples in the equator region.

TABLE 11

| | Carry (m) | Run (m) | Total (m) | Elevation angle symmetry* (°) | Carry symmetry* (m) |
|---|---|---|---|---|---|
| E1 | 235 | 25 | 260 | 0.1 | 1 |
| E2 | 233 | 28 | 261 | 0.0 | 0 |
| E3 | 236 | 26 | 262 | 0.2 | 1 |
| CE1 | 232 | 24 | 256 | 0.1 | 2 |
| CE2 | 233 | 25 | 258 | 0.2 | 4 |
| CE3 | 233 | 22 | 255 | 0.0 | 3 |
| CE4 | 233 | 21 | 254 | 0.1 | 4 |
| CE5 | 228 | 23 | 251 | 0.1 | 3 |

*Average on pole hitting minus average on seam hitting

Additionally, golf balls of the four-layer structure shown in FIG. 4 were manufactured and examined for performance.

The core was made of the same material as in Example 1 and had a diameter of 34.07 mm. The cover inner layer was made of a polyester resin and had a Shore D hardness of 40 and a gage of 1.6 mm. The cover intermediate layer was made of an ionomer resin and had a Shore D hardness of 64 and a gage of 1.1 mm. The cover outer layer was made of another ionomer resin and had a Shore D hardness of 52 and a gage of 1.6 mm.

The dimple arrangements were the same as in Examples 1 and 2 and Comparative Examples 1 and 2.

The results are shown in Table 12.

TABLE 12

| Dimple arrangement | Ball structure | Carry (m) | Run (m) | Total (m) | Elevation angle symmetry* (°) | Carry symmetry* (m) |
|---|---|---|---|---|---|---|
| E1 | 4-layer | 237 | 24 | 261 | 0.1 | 1 |
| E2 | 4-layer | 236 | 27 | 263 | 0.1 | 1 |
| CE1 | 4-layer | 233 | 21 | 254 | 0.1 | 3 |
| CE2 | 4-layer | 234 | 20 | 254 | 0.0 | 3 |

*Average on pole hitting minus average on seam hitting

A comparison of Tables 11 and 12 reveals that four-piece solid golf balls are superior to two-piece solid golf balls when dimples are arranged thereon according to the invention. This is probably because the four-piece solid golf ball is launched at a relatively low spin rate (5% reduction) which leads to an increase of horizontal distance.

There have been described golf balls which are improved in the symmetry of elevation angle and carry and increased in the total distance.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball having a spherical surface, wherein when the spherical surface is divided into a plurality of substantially congruent spherical triangles, circular dimples in plane shape are substantially equally distributed in the spherical triangles, the spherical triangles are minimum triangular units which are substantially congruent with each other, the circular dimples distributed in each said minimum triangular unit include crossing dimples that each lie across at least one side of the minimum triangular unit, and the total of the crossing lengths of the circular dimples which lie across the respective sides of the minimum triangular unit is 70 to 80% of the total length of all the sides of the minimum triangular unit.

2. The golf ball of claim 1 wherein the total of the crossing lengths of the crossing dimples is 75 to 80% of the total length of all the sides of the minimum triangular unit.

3. The golf ball of claim 1 wherein the circular dimples account for 70 to 80% of the entire surface area of the ball.

4. The golf ball of claim 1 wherein the minimum triangular unit is obtained by dividing the spherical surface into twenty spherical triangles of a regular icosahedron, and drawing perpendicular lines from the apexes of each said spherical triangle to divide the triangle into six triangular units.

5. The golf ball of claim 1 wherein the minimum triangular unit is obtained by dividing the spherical surface at an equatorial into north and south hemispheres, and dividing each of the north and south hemispheres about its north or south pole along longitudes into six spherical triangular units having a vertex angle of 60°, thus defining twelve spherical triangular units in total.

6. The golf ball of claim 1 comprising a solid core of a single layer or plural layers and a cover of at least three layers enclosing the core.

7. The golf ball of claim 4, wherein the dimple lying across a side of the minimum triangular unit is disposed so that the side divides the dimple into substantially equal two halves.

8. The golf ball of claim 5, wherein the minimum triangular unit includes dimples which slightly lie across the side of the minimum triangular unit that is coincident with an equatorial plane.

9. The golf ball of claim 1, wherein said circular dimples are all of the same diameter and depth.

10. The golf ball of claim 9, wherein said circular dimples range in number between 320to 500.

11. The golf ball of claim 1, wherein said circular dimples are of plural types of different in diameter and/or depth.

12. The golf ball of claim 11, wherein said circular dimples have diameters in the range of 1.8 to 4.5 mm.

13. The golf ball of claim 11, wherein said circular dimples have depths in the range of 0.07 to 0.22 mm.

14. The golf ball of claim 11, wherein said circular dimples comprise four groups, each group having a different diameter.

15. The golf ball of claim 14, wherein the number of dimples in a group is respectively 90, 120, 132 and120.

16. The golf ball of claim 14, wherein the number of dimples in a group is respectively 24, 36, 180 and 198.

17. The golf ball of claim 11, wherein said circular dimples comprise three groups, each group having a different diameter.

18. The golf ball of claim 17, wherein the number of dimples in a group is respectively 120, 192 and 180.

19. The golf ball of claim 1, wherein crossing dimples lie across all sides of the minimum triangular unit.

* * * * *